United States Patent [19]

Sovia et al.

[11] 3,970,025

[45] July 20, 1976

[54] CATAMARAN

[76] Inventors: Cedric C. Sovia, 319 S. Lake St., Forest Lake, Minn. 55025; Kenneth W. Krengel, 1800 Highland Parkway, St. Paul, Minn. 55116

[22] Filed: Sept. 11, 1974

[21] Appl. No.: 504,966

[52] U.S. Cl. ..... 114/61; 114/39

[51] Int. Cl.[2] ..... B63B 1/00

[58] Field of Search ..... 114/39, 43, 61, 66 SF, 114/123

[56] References Cited

UNITED STATES PATENTS

| | | | |
|---|---|---|---|
| 1,364,961 | 1/1921 | Thompson | 114/61 |
| 2,106,432 | 1/1938 | McIntyre | 114/39 |
| 3,265,026 | 8/1966 | Hamilton | 114/39 |
| 3,601,076 | 8/1971 | Meeks | 114/39 |
| 3,616,772 | 11/1971 | Popkin | 114/39 |

*Primary Examiner*—Trygve M. Blix
*Assistant Examiner*—Jesus D. Sotelo

[57] ABSTRACT

A catamaran includes a system of at least two pairs of opposed pontoons arranged in tandem relation with one pair forwardly of the other. Each pontoon is supported near its mid point on a generally vertical axis to a superstructure. The pontoons of one pair are connected by a cross connecting member pivoted to the pontoons of said one pair along generally vertical axes at points equally spaced from the pivots connecting said pontoons to said superstructure, so said pontoons of said one pair are held in substantially parallel relation. The rear end of each forward pontoon of one pair is pivotally connected to the forward end of the pontoon of the other pair on opposite sides of longitudinal center between said pontoons. This pivotal movement of the pontoons of one pair about their vertical pivot near their mid point acts to rotate the mid points of the pontoons of the other pair in the opposite direction about their vertical axes.

In another form of the invention, the front pair of pontoons are held parallel to the direction of travel, and the rear pontoons are connected in parallel relation to steer the catamaran. This type of steering is provided in lieu of a rudder. The steering makes it possible to use the catamaran on snow or ice, as well as on the water.

3 Claims, 10 Drawing Figures

CATAMARAN

This invention relates to an improvement in catamaran and deals particularly with a catamaran structure in which the boat may be easily turned and manipulated.

BACKGROUND OF THE INVENTION

This device is particularly designed for use in combination with a vehicle which is the subject matter of a pending application. However, it can be used on various other types of crafts and is being separately filed for this reason.

In many cases, the catamaran is used as a sailing vehicle. A deck is usually provided supported by a pair of parallel pontoons. The sail is supported upon the deck to extend therefrom. A rudder is usually provided for steering the boat, the tiller extending down into the water so that by pivoting the tiller body vertically axis, the boat may be directed in one direction or another. In other words, while some such devices are quite complicated including cabins for accommodating the plurality of persons, the device in general is similar to any sail boat, except for the fact that it includes a pair of parallel hulls instead of a single hull, the craft being accordingly much more stable in the water.

SUMMARY OF THE INVENTION

The present device comprises a water craft which is supported by two pairs of pontoons. These pontoons are somewhat shorter than the normal pontoon of a catamaran, and comprise a pair of spaced parallel forward pontoons, and a pair of spaced parallel rear pontoons. Each pair of pontoons is supported upon a substantially vertical pivot approximately midway between the fore and aft ends of the pontoon. A deck structure suitable for supporting one or more persons is supported by a pair of fore and aft transverse arms, the ends of which are pivotally connected to the pontoon.

A novel feature of the present invention resides in the fact that the forward end of one of the rear pontoons is pivotally connected by a connecting arm to the rear end of the pontoon on the opposite side of the longitudinal center. The forward end of the second rear pontoon is pivotally connected by a connecting arm to the rear end of the other forward pontoon. Means are provided for pivoting the rear pontoons in unison.

With this arrangement, when the forward ends of the rear pontoon are swung to the left of the longitudinal center line of the craft, the rear ends of the forward pontoons are pivoted in the opposite direction. As a result, the forward end of each rear pontoon remains directly behind the rear end of the forward pontoon. As a result, during forward movement, of the craft, the craft is guided in an arcuate direction. This arrangement provides great manuverability to the craft and permits the ready control of the craft either in one direction or another.

The steering mechanism which is indicated is extremely simple in its construction. In the particular arrangement illustrated, it comprises merely a pair of links extending transversely of the center line of the boat which are pivotally connected at one of their ends to the forward pontoons near the rear ends thereof. These links are connected at their other ends to the rear pontoons. A second cross connecting member is provided parallel to the cross member to which the pontoons are pivoted. A tiller is provided extending longitudinally by means of which this rearward cross member may be moved. By moving the cross member in one direction the rear pontoons will be pivoted about their central vertical axis, and this action will, in turn, pivot the forward pontoons in opposite directions upon their vertical axes.

In another form of the construction, the forward pair of pontoons are connected in parallel relation to the direction of travel. The rear pontoons are pivotally connected to the frame of the catamaran on vertical pivots near their forward ends. A cross connecting member is vertically pivoted to said rear pontoons in spaced relation to the rear ends thereof. A second cross member is vertically pivoted to the rear ends of the rear pontoons. A tiller is connected to this second cross member by means of which the rear pontoons may be pivoted in unison.

In usual practice, a generally rectangular frame is provided having parallel side members, and parallel front and rear members. A sail is provided including a tripod-like support including a socket in the center of the front member designed to support a mast at an upwardly and rearwardly extending angle, and a pair of supports engaged in sockets in the parallel side members, and including means of connecting their upper ends to the mast near its upper end. A mast extension is attached in telescoping relation to the upper end of the mast. This arrangement permits the mast and its supports to be detached and folded into compact shape. The sail is generally triangular, the forward edge being connected to the mast and mast extension. The lower rear corner of the sail is connected through a rope and pulleys to the rear cross member of the frame.

In preferred form, the catamaran deck or chassis is designed for a single passenger, and is suspended between the rear cross member of the frame and an intermediate frame member spaced rearwardly the front cross member of the frame. Braces may extend longitudinally of the frame between the rear cross member and the intermediate cross member on opposite sides of the deck.

These and other objects and novel features of the present invention will be more clearly and fully set forth in the following specification and claims:

DESCRIPTION OF THE PREFERRED EMBODIMENTS

Figure 1:
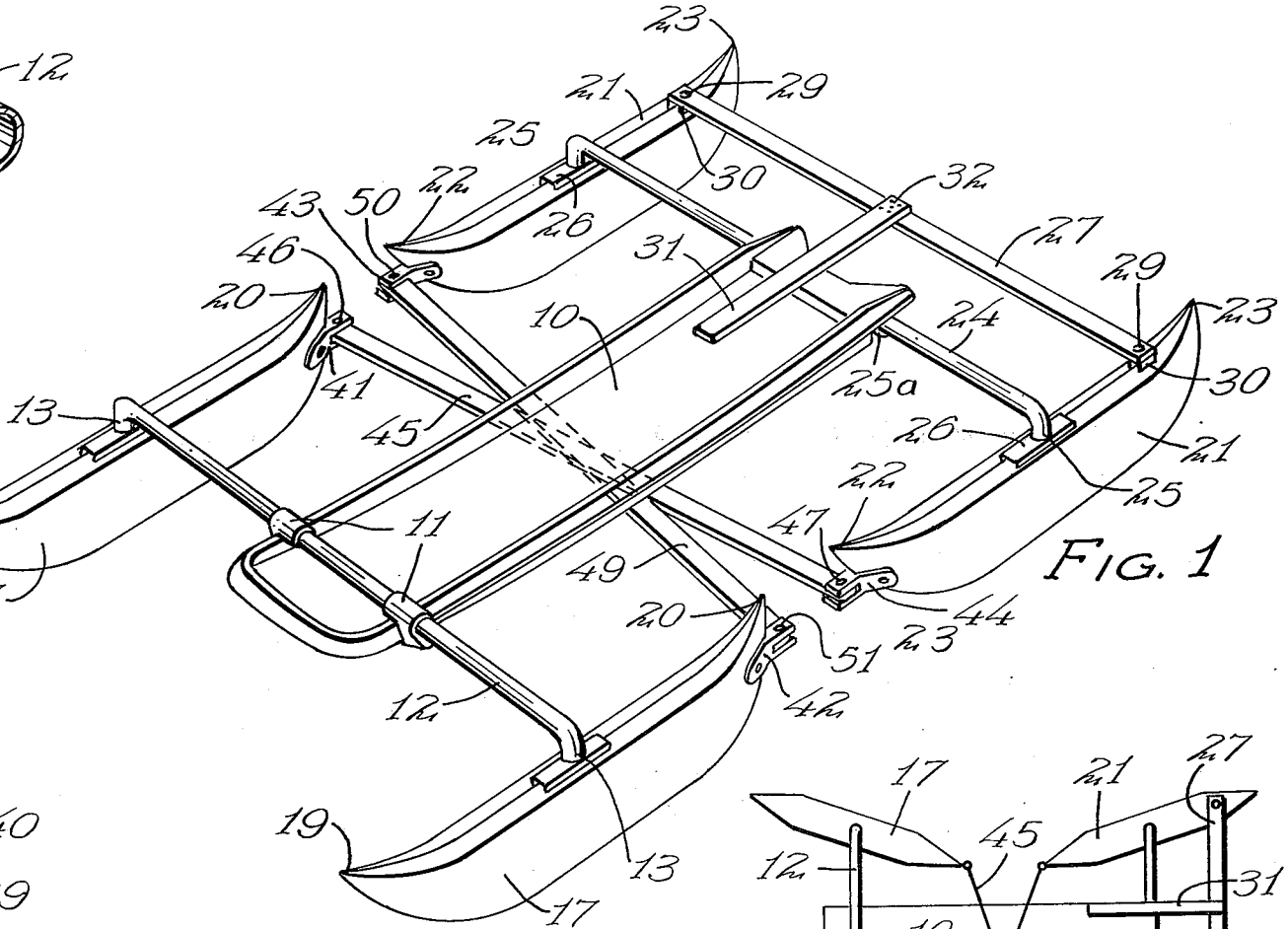
FIG. 1 is a perspective view of the catamaran, showing the general arrangement of parts.

The apparatus illustrated includes an elongated chassis 10 which is preferably formed of structural foam although obviously the member 10 can comprise a deck of considerable size such as is used on the usual pontoon boat, or may comprise a cabin structure to accommodate passengers. The body or deck 10 is connected by a suitable securing means 11 to a transverse arm 12 which is shown as having downward turned ends 13. For the purpose of illustration, the downturned ends 13 comprises a vertical socket designed to accommodate an upwardly extending bearing 14 mounted on a vertical pivot 15 secured to an inverted channel-shaped bracket 16. The bracket 16 is designed to be secured to the top of the pontoons in fixed relation thereto.

The forward pontoons 17 comprise elongated floats of suitable shape having pointed forward and rear ends 19 and 20 respectively. The shape of the pontoons 17 is merely a matter of choice, as some pontoons are of cylindrical form having a conical forward end and a blunt rear end, and others are otherwise shaped. The pontoons shown in the present structure would function effectively traveling in a rearward direction as in a forward direction and this is merely a matter of choice and selection.

Figure 2:
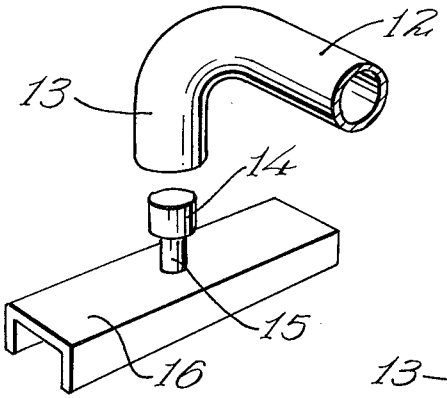
FIG. 2 illustrates diagrammatically a pivotal connection between one of the pontoons and one of the cross members.
Figure 3:
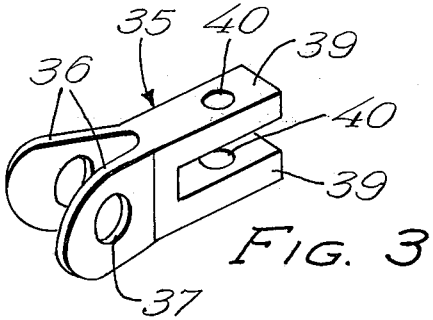
FIG. 3 is a diagrammatic view of a clevis of the type secured to the rear ends of the forward pontoons and the forward ends of the rear pontoons.

The rear pontoons 21 are shown shaped similarly to the front pontoons 17 although, here again, this is merely a matter of choice. The pontoons 21 are shown with pointed forward ends 22 and pointed rear ends 23. A cross arm 24 is secured fixedly to the rear of a body 10 by clamping means 25 not shown in detail in the drawings. The cross members 12 and 24 combine with the body 10 to form a catamaran. The ends of the transverse arms 24 are bent downwardly as indicated at 25, and are pivotally secured to channels 26 which are fixedly connected to the upper surfaces of the pontoons 21 in a desirable manner such as is diagrammatically indicated in FIG. 2 of the drawings. A second cross arm 27 is pivotally secured at its ends 29 to brackets 30 mounted upon the upper surfaces of the pontoons 21 near the rear extremity thereof. The cross arm 27 is parallel to the cross arm 24, and serves to hold the pontoons 21 in parallel relation. A tiller 31 is secured at 32 to the cross arm 27. Obviously, a pivoted lever could serve as the tiller, or any suitable means may be provided for providing lateral movement to the connecting arm 27 relative to the cross arm 24. Clevises 35 of the type generally illustrated in FIG. 3 of the drawings may be provided on the forward ends of the rear pontoons 21 and on the rear ends of the forward pontoons 17. The clevises 35 are shown as including diverging end portions 36 which are apertured as indicated at 37 to accommodate fastening means. Each clevis 35 is also provided with a pair of vertically spaced bracket arms 39 which are provided with aligned apertures 40 to accommodate a pivot bolt or the like. While all of the clevises are similar to that indicated in FIG. 3, the clevis at the rear end of one forward pontoon 17 will be indicated by the numeral 41 and the clevis connected to the rear end of the other forward pontoon 17 will be indicated by the numeral 42. In a similar manner clevises 43 and 44 are secured to the forward ends of the rear pontoons 21 in the manner clearly shown in FIG. 1 of the drawings.

A First link 45 is pivotally connected at 46 on a vertical pivot to the clevis 41, and the other end of the link is connected on a vertical pivot 47 to the clevis 44. In a similar manner, a second link 49 is pivotally connected at 50 to the clevis 43 and is pivotally connected at 51 to the clevis 44.

Figure 4:
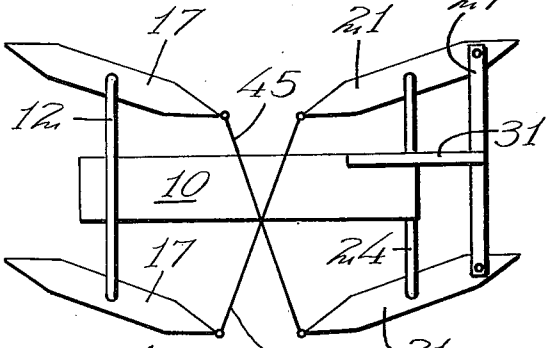
FIG. 4 is a diagrammatic view indicating the manner in which the pontoons operate when pivoted about their generally central axes.

With the arrangements illustrated, it will be seen that movement of the cross member 27 in a lateral direction will pivot the rear pontoons 21 in one direction about their central pivot axes. At the same time, the links 45 and 49 will act to pivot the pontoons 17 in the opposite direction about their vertical axes. FIG. 4 is a diagrammatic view of the manner in which the pontoons will pivot if the tiller 31 is moved in one direction. In the same manner, if the tiller 31 is moved in the opposite direction, the pontoons will pivot in a reverse direction. By properly manipulating tiller 31, the pontoons may be moved either into alignment, or into a following path, in the manner illustrated in the drawings.

The catamaran C illustrated in FIGS. 5 through 10 of the drawings shows a somewhat heavier and more rigid frame, and indicates the manner in which the sail may be supported by the frame. The catamaran C includes a pair of longitudinally extending side frame members 55 which are connected to a front cross member 56 by right angular corner members 57, and connected by a rear cross member 59 by corner connecting members 60. The catamaran includes a pair of forward pontoons 58, and a pair of rear pontoons **58*a*. A pair of brackets 61 are supported upon the frame side 55, and supported vertical shafts 62 which are anchored to the pontoons 58 at 63, and the anchoring portions being normally forward of the longitudinal center of the pontoons. Brackets 64 are also mounted on the side members 55 and supported vertically extending members 65 which are anchored to the pontoons 58 as indicated at 66. The anchoring members 66 are preferably rearwardly of the longitudinal center of the pontoons 58.**

The frame sides 55 also support opposed brackets 67 including vertical members 69 which are pivotally supported at the forward ends of the rear pontoon 62 by pivot supports 70. The pivots 69 and supports 70 form the main means of connecting the rear pontoons 62 to the frame sides 55.

A cross connecting member 71 is provided with down turned ends 72 which are pivotally supported by pivot supports 73 on the rear pontoons **58*a*. The connecting means 71 provides a manner of holding the rear pontoons 58*a*** always in parallel relation as they are pivoted relative to the frame.

A rearmost connecting member 74 is provided at its ends with bearings 75 pivotally supported by pivot pins 76 extending upwardly from the rear ends of the pontoons **58*a*. The connecting member 74 is provided with an upwardly offset center portion 77, and the upwardly offset portion 77 includes a clevis 79 (see FIG. 8) having a threaded shaft 80 which extends through the offset portion 77 by means of an aperture 81 and the clevis is secured to the member 77 by the nut 82. The clevis 79 is somewhat like an oarlock in shape and includes parallel sides 83 which accommodates a tiller 84 therebetween, the tiller being pivoted about a horizontal axis by a pivot pin 85 extending through the parallel sides 83 of the clevis. The purpose of this arrangement is to permit the tiller to be pivoted vertically so that it may be operated by a person sitting or standing on the chassis or deck 86** of the pontoon.

A transverse cross member 87 connects the side frame members 55 in rearwardly spaced relation to the forward cross member 56. The chassis 86 is supported by this cross member 87 and the rear cross member 59. The forward cross member is connected to the side frame members by T-shaped connections 89. If desired, longitudinal frame members 90 may be connected between the rear cross member 59 and the intermediate cross member 87 by suitable brackets 91. The chassis or deck 87 is similar in shape to that of the multipurpose vehicle illustrated in our co-pending application for this vehicle Ser. No. 470,055, filed May 15, 1974.

A T-shaped connector 93 is mounted at the center of the front cross member 56 and provides an upwardly inclined socket to detachably support a mast 94 which extends upwardly and rearwardly from the front cross member 56. The sides of 55 are also provided with T-shaped connectors 95 designed to accommodate bracers 96 extending upwardly and inwardly therefrom. The mast 94 and the supports 96 form a tripod arrangement for supporting the sail 97.

Figures 6, 7, 8:
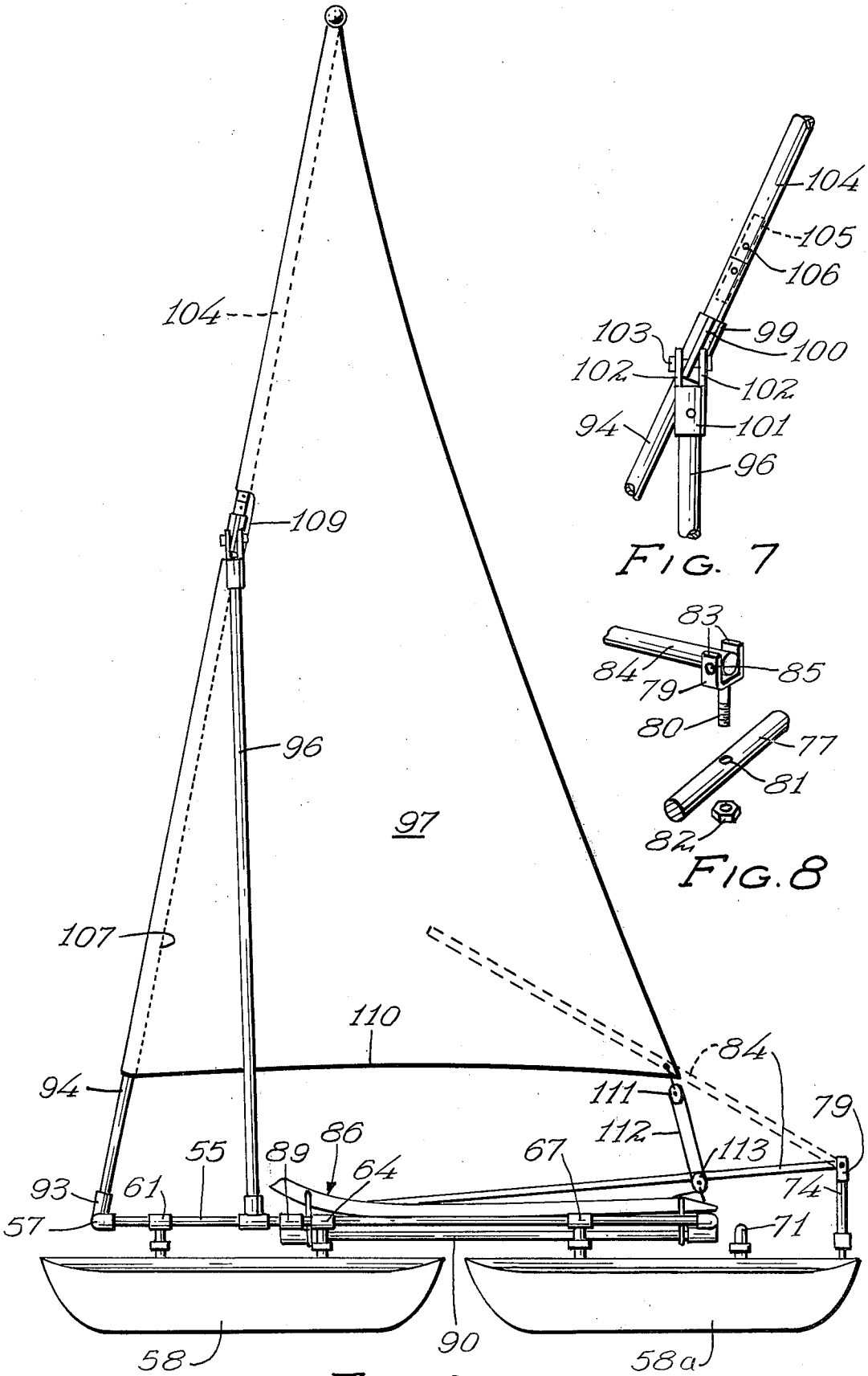
FIG. 6 is a side elevational view of the catamaran showing its readiness for use.
FIG. 7 is a detail of the connection between the mast and its supports.
FIG. 8 is a detail of the connection between the tiller and the rearmost pivoted transverse connecting member.

As indicated in FIG. 7 of the drawings, a sleeve 99 is provided near the upper end of the mast 94 and is provided with laterally extending apertured ears 100. A clevis 101 is provided with spaced parallel ears 102 designed to accommodate the ears or wings 100 therebetween. A bolt 103 connects the upper ends of the supports 96 to the mast 94 forming a support therefore.

A mast extension 104 is telescopically mounted on the reduced diameter projection 105 at the top of the mast 94 and is pinned or bolted thereto as indicated at 106.

The sail 97 is provided with a hem 107 along its forward edge which encircles the mast 94 and mast extension 104 and which is interrupted as indicated at 109 to accommodate the sleeve 99. The sail 97 is generally triangular, the lower edge 110 being generally horizontal when not subjected to the wind.

Figure 5:
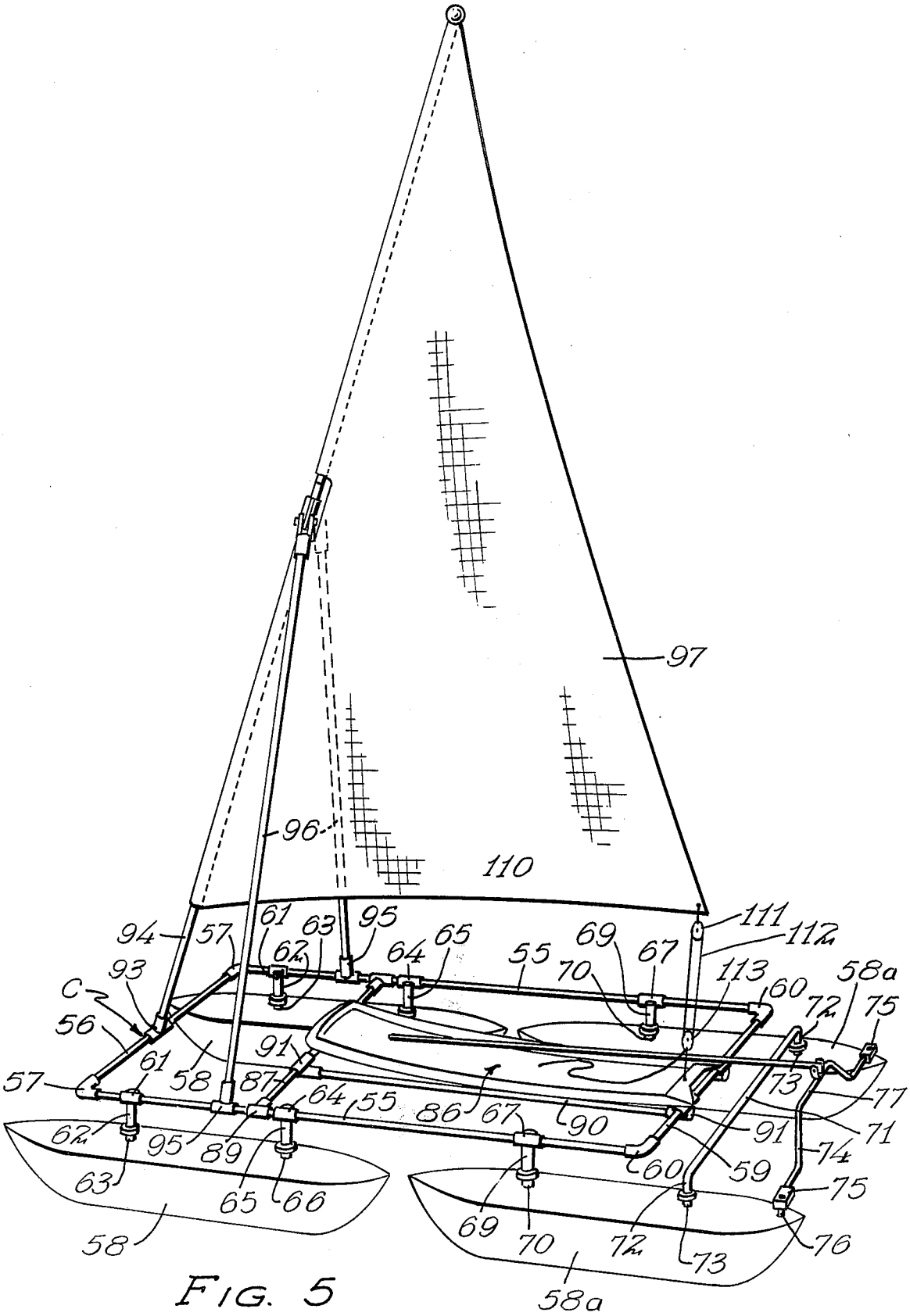
FIG. 5 is a perspective view of a modified form of construction.

As shown in FIG. 5 a pulley 111 is secured to the lower rear corner of the sail 97, and a pulley 113 is flexibly connected to the deck or chassis 86 at the rear end thereof. A rope 112 is threaded through these pulleys, and the rope may be used in the usual manner for letting out the sail or pulling it in the operation of the catamaran.

The operation of the catamaran is believed apparent from the foregoing description. The frame, mast and mast supports are preferably made of light weight tubing and the pontoons are preferably made of expanded polyethylene or polystyrene which is of extremely light weight. The device is so constructed that the mast and mast supports may be disconnected from the frame and lowered. By removing the connecting pin or bolt 106 the mast extension 104 may be disconnected from the mast and folded into side by side relation to the mast, and the sail may be wound thereabouts. If desired the deck or chassis 86 may be easily removed, and the frame may be detached from the pontoon in a short period of time. Thus, the device may be put into compact form for transportation when it is so desired.

Figure 9:
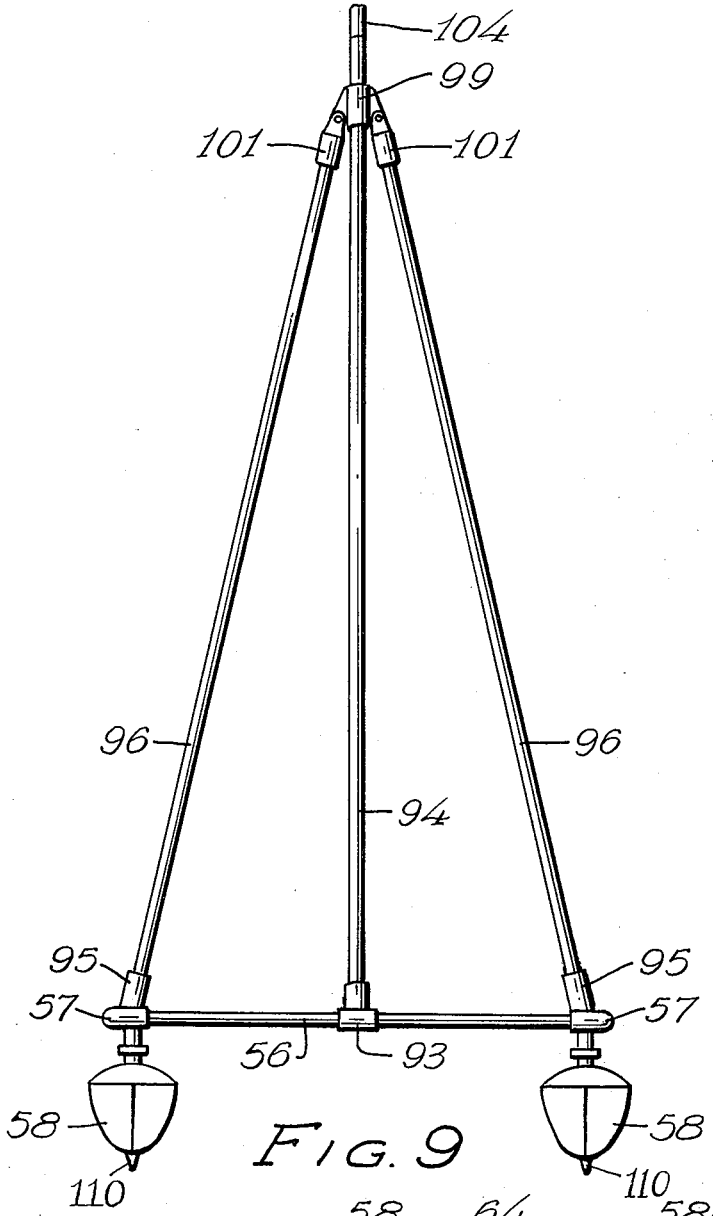
FIG. 9 is a front elevational view of the catamaran frame a portion of the mast extension being broken away, and the deck and steering mechanism omitted for the sake of clarity.
Figure 10:
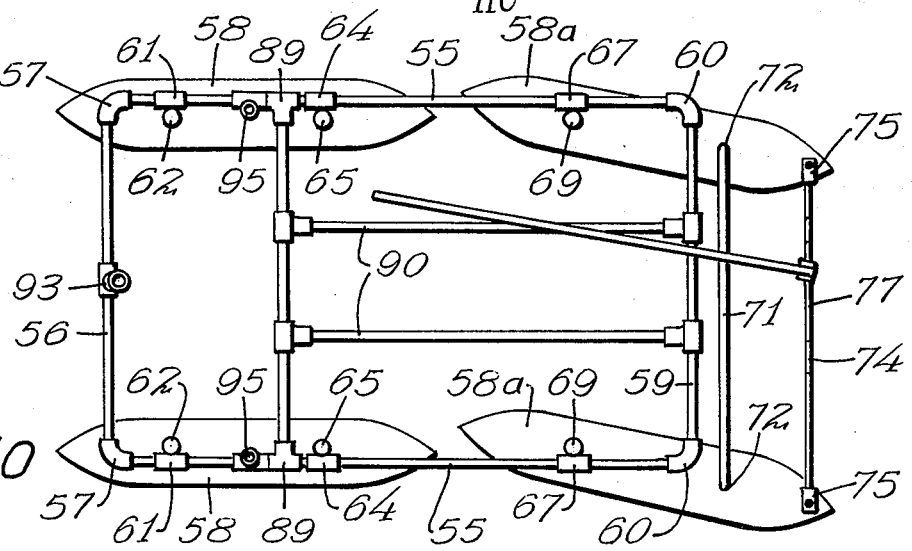
FIG. 10 is a plan view of the frame and pontoons, showing the manner in which the pontoon is steered.

While the catamaran has been described as a water craft, the device may be used the year around. As indicated in FIG. 9, the pontoons such as 58 and **58*a* have runners or longitudinally extending skates 110** on their under surfaces, making the device operable on ice in the manner of an iceboat. Furthermore, the under surfaces of the pontoons are sufficiently wide to permit the craft to sail over snow as well as water and ice. In other words, the vehicle may be used throughout the year. In colder climates, when the water of a lake or river freezes, the vehicle will glide over the ice with less friction than in the water, and if the vehicle travels over thin ice and breaks through, it will float on the water, and the tapered forward ends of the pontoons may cause the catamaran to climb back onto the ice. If the ice is covered with snow, it will travel over the snow with equal ease. This is one of the great advantages of the craft over a pontoon which depends upon a rudder for steering. The rudder normally used to steer such craft would be useless on ice or snow. Thus one of the most important features of the present device lies in the ability of the craft to be used in all weather as long as there is sufficient wind to propel the same over any reasonably level surface.

In accordance with the Patent Statutes, we have described the principles of construction and operation of our catamaran, and while we have endeavored to set forth the best embodiments thereof, we desire to have it understood that obvious changes may be made within the scopes of the following claims without departing from the spirit of our invention.

We claim:

1. A catamaran including:

a catamaran frame having a longitudinal centerline, a forward pair of parallel pontoons connected to said frame on opposite sides of said centerline, a rear pair of parallel pontoons pivotally connected to said frame on parallel vertical axes on opposite sides of said centerline, means connecting said rear pontoons for pivotal movement in spaced parallel relation, and means for moving said connecting means to pivot said rear pair of pontoons, said forward pair of pontoons being also connected to said frame on parallel vertical pivots, said frame being of generally rectangular form, and including vertical pivot means extending downwardly from said frame into engagement with said pontoons.

2. The structure of claim 1 and in which said forward pair of pontoons are secured to said frame parallel to said longitudinal centerline.

3. The structure of claim 1 and in which said means for moving said connecting means includes a tiller, and means on said connecting means pivotally supporting said tiller on a horizontal axis.

* * * * *